United States Patent [19]

Langley

[11] Patent Number: 4,724,577

[45] Date of Patent: Feb. 16, 1988

[54] SPRING FORCE COMPENSATOR FOR SASH BALANCES

[76] Inventor: Lawrence W. Langley, 910 Cardinal Dr., Christiansburg, Va. 24073

[21] Appl. No.: 920,175

[22] Filed: Oct. 17, 1986

[51] Int. Cl.[4] ..... E05F 5/00

[52] U.S. Cl. ..... 16/197; 16/214; 49/451

[58] Field of Search ..... 16/197, 193, 203, 205, 16/206, 202, 211, 212, 213, 214; 49/446, 445, 451, 414, 429, 181, 441

[56] References Cited

U.S. PATENT DOCUMENTS

| | | | |
|---|---|---|---|
| 3,197,819 | 8/1965 | Trout | 16/197 |
| 3,233,278 | 2/1966 | Landgren | 16/197 |
| 3,407,434 | 10/1968 | Scott | 16/193 |
| 3,441,978 | 5/1969 | Perry | 16/197 |
| 3,466,806 | 9/1969 | Teggelaar | 49/445 |
| 4,571,887 | 2/1986 | Haltof | 16/197 |

*Primary Examiner*—Nicholas P. Godici
*Assistant Examiner*—G. M. Reid

[57] ABSTRACT

The invention is a force compensation device for use in a spring balanced sash holder for a jamb liner extruded from a durable resin such as polyvinyl chloride, and having a vertical track for containing the sash. Within the vertical track in the sash plow region and running the entire length of the jamb liner is a vertical slotted channel. The lower half of the slotted channel is used to develop frictional force for compensation of spring balance forces. The invention produces its compensating force by frictionally engaging the surfaces of the slotted channel. It comprises two parts, a carrier and a clapper. The carrier supports the weight of the sash, and is supported by the balance spring. The clapper is attached to the carrier. Both the carrier and clapper have braking elements which frictionally engage the surfaces of the slotted channel of the jamb liner track. The carrier and clapper are fastened together at their lower ends but their upper ends are free to move relative to each other. The braking elements, which are integral parts of the the carrier and clapper upper ends, are urged together by a sideways force which is produced by the end of the balance spring. The end of the spring acts on an inclined surface of the carrier and on a vertical surface of the clapper to produce the sideways force.

13 Claims, 7 Drawing Figures

SPRING FORCE COMPENSATOR FOR SASH BALANCES

BACKGROUND OF THE INVENTION

The use of springs to partially support or "balance" the weight of a window sash is almost universal in the building trade. Arrangements of sash weights, pulleys and cords which were used in the past have practically gone out of existence. A spring balance cannot exactly match the weight of a sash over its travel, however, because the spring force varies with the spring extension. A spring balance holding device for a sash must have some means for adjustment of the net force applied by the spring, or the sash will not stay in position at all points of its travel. Many spring-actuated sash holding devices have been designed and are in commercial use. For example, the "Automatic Friction Sash Holder" of U.S. Pat. No. 4,571,887, issued to Garry P. Haltof, uses the vertical motion of two opposed wedges to develop a sideways motion and a frictional force against the jamb liner proportional to the force of the spring acting against the weight of the sash. The frictional force produced by the wedges resists vertical motion of the sash, and if the difference between the upward force of the spring and the weight of the sash is less than the frictional force, the sash will remain stationary. To move the sash up or down, the operator of the window only needs to apply a force slightly greater than the residual of friction: the sash will move easily but stay in place when the external force is removed.

There are problems with the Haltof sash holding device and others like it, however, the jamb liner and sash holder surface areas which develop frictional force are small, and the initial proportionality between vertical force and frictional force degrades rapidly with wear and distortion of the parts. It is extremely difficult to design a sash holder which has a proportional frictional force great enough to hold the sash, a low wear rate, and at the same time is free from "lockup" or excessive stick-slip during sash motion.

By changing the manner in which frictional force is devloped from the vertical force, I have improved the sash holder and at the same time simplified it. The improvements are given in detail in the following specification and accompanying drawings, which describe and illustrate a preferred embodiment of the Spring Force Compensator.

SUMMARY OF THE INVENTION

A conventional jamb liner is extruded from a durable resin such as polyvinyl chloride, and has two vertical tracks for containing two sashes. Within each vertical track in the sash plow region and running its entire length is a vertical slotted channel. In the upper half or the sash plow region the slotted channel is normally used to hold a spring cover in place. The lower half of the slotted channel in each vertical track of a jamb liner is commonly used by the sash holding mechanism to develop frictional force for compensation of spring balance forces.

My invention like other commercially available sash holders, produces its compensating force by frictionally engaging the surfaces of the slotted channel in the lower half of the jamb liner track. It consists of two parts, a carrier and a clapper. The carrier supports the weight of the sash, and is supported by the balance spring. The clapper is attached to the carrier by a clip or equivalent means. Both the carrier and clapper have braking elements which frictionally engage the surfaces of the slotted channel of the jamb liner track. The carrier and clapper are fastened together at their lower ends but their upper ends are free to move relative to each other. The braking elements, which are integral parts of the the carrier and clapper upper ends, are urged together by a sideways force which is produced by the end of the balance spring. The end of the spring acts on an inclined surface of the carrier and on a vertical surface of the clapper to produce the sideways force.

DETAILED DESCRIPTION OF THE INVENTION

Figure 1:
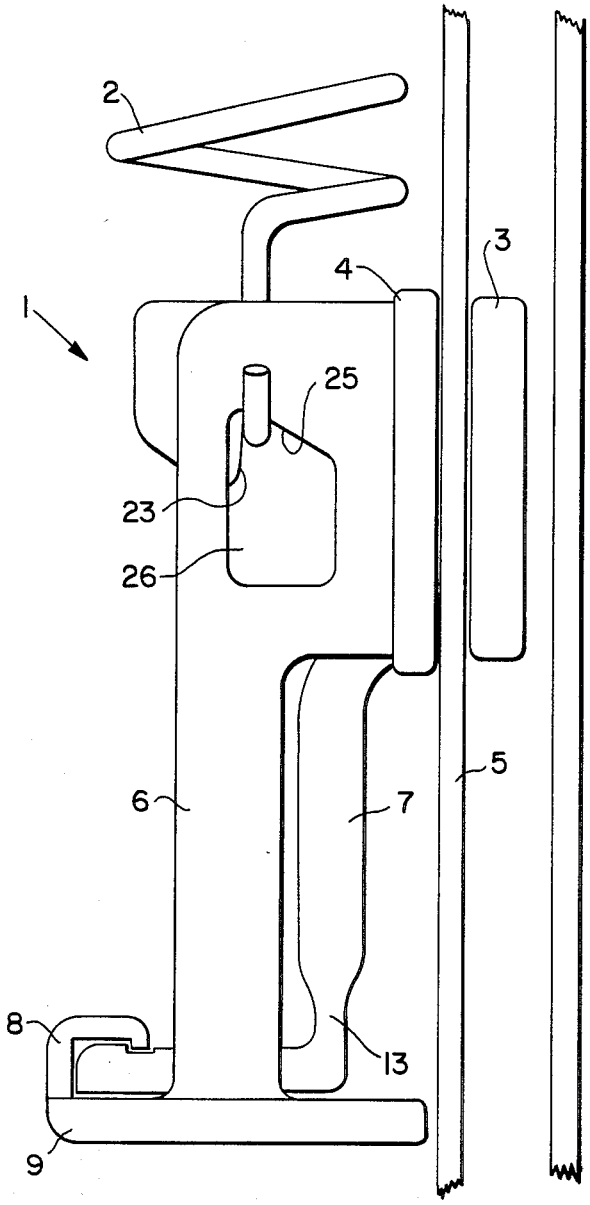
FIG. 1 is a view normal to the plane of the sash, showing the carrier and clapper of the invention, assembled and supported by the lower end of a balance spring and frictionally engaging the slotted channel, which is shown in section.

In FIG. 1 the invention is shown as it would be employed in a typical sash holding application. The Spring Force Compensator 1 comprises a carrier 6 and clapper 7 which are assembled and held together by a clip 8. The lower end of a balance spring 2 passes through an aperture 26 in the carrier 6. The braking elements 3 and 4, which are part of clapper 7 and carrier 6 respectively, frictionally engage the inner and outer surfaces of the slotted channel 5, which is part of the jamb liner. The bottom surface of the sash (not shown) rests on the platform 9 and is thus supported partly by the force of the spring 2, acting on the carrier 6.

Figure 2:
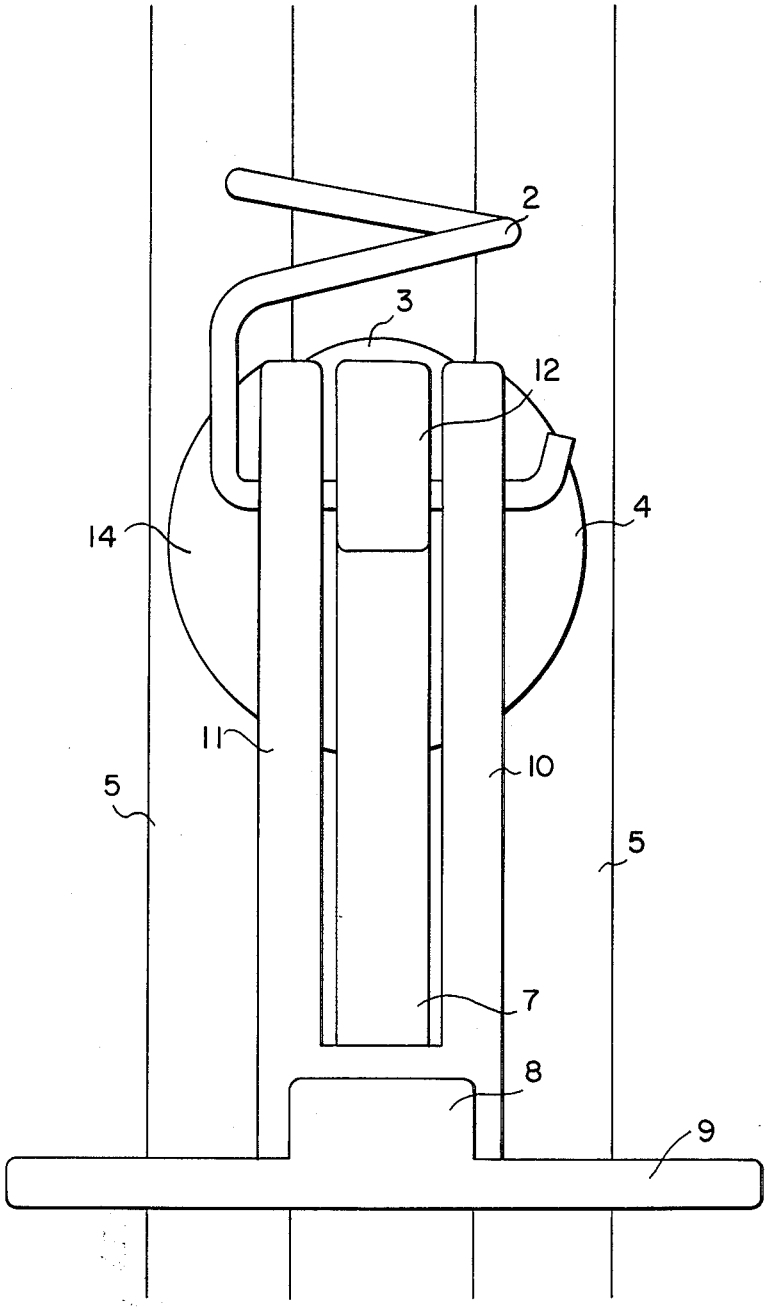
FIG. 2 is a horizontal view in the plane of the sash, showing the same elements as FIG. 1.

FIG. 2 illustrates that the carrier 6 has two vertical members 10 and 11. The clapper 7 is located between the vertical members 10 and 11 of the carrier, with its upper end 12 free to move in a plane parallel to the sash. A thin section 13 of the clapper (shown best in FIG. 1) acts as a hinge or flexure. Each vertical member of the carrier has a braking element 4 and 14, semi-circular in profile, frictionally engaged with the surfaces of the slotted channel which face the sash. The clapper has a braking element 3, circular in profile, held in frictional engagement with the other surfaces of the slotted channel. The braking elements of the carrier and the clapper squeeze the slotted channel between them, much as the pads of a disc brake squeeze the rotor.

Figure 3:
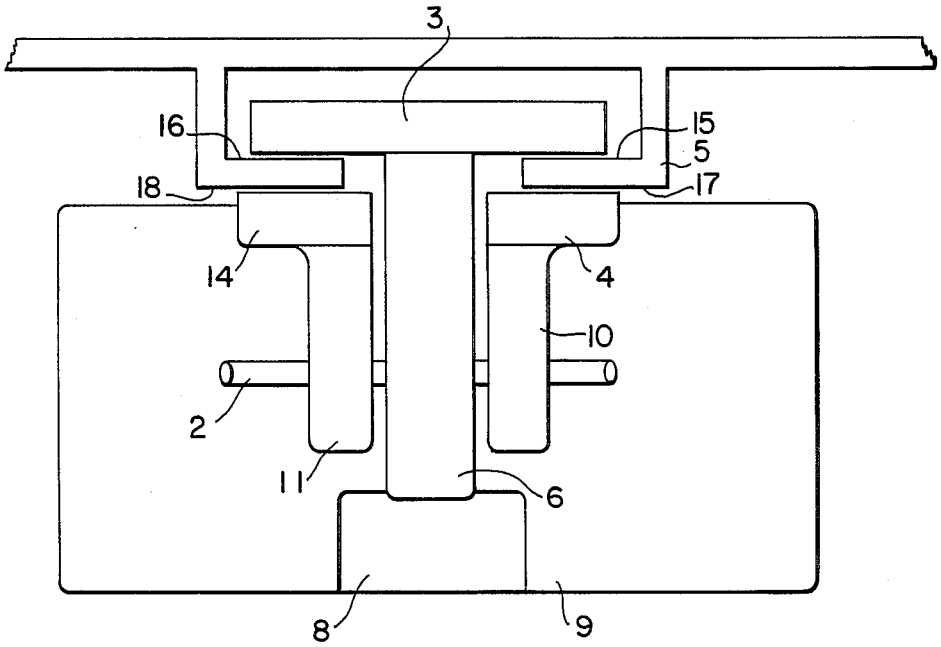
FIG. 3 is a view from above of the device shown in FIG. 1 and FIG. 2.

FIG. 3, a view of the Spring Force Compensator from above, shows the relationship between the braking elements of the clapper and the carrier. The clapper braking element 3 engages the inner surfaces 15 and 16 of the slotted channel. The carrier braking element 4 and 14 engage the outer surfaces 17 and 18 of the slotted channel. The body of the clapper 6 is free to move between the vertical members 10 and 11 of the carrier.

Figure 4:
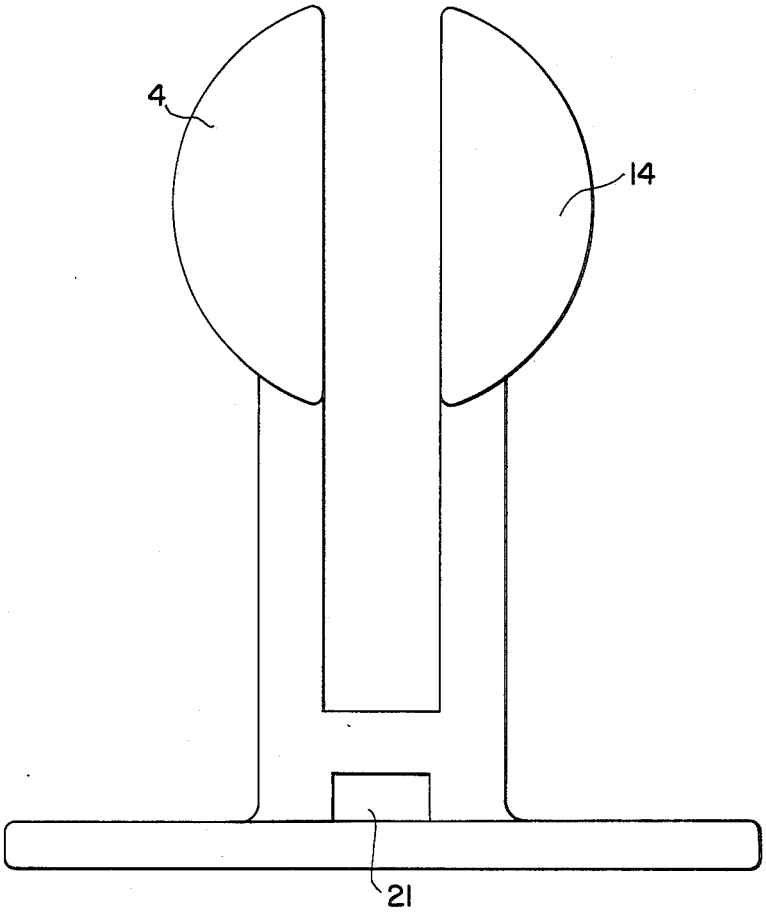
FIG. 4 is a view of the carrier showing the side which faces the slotted channel.
Figure 5:
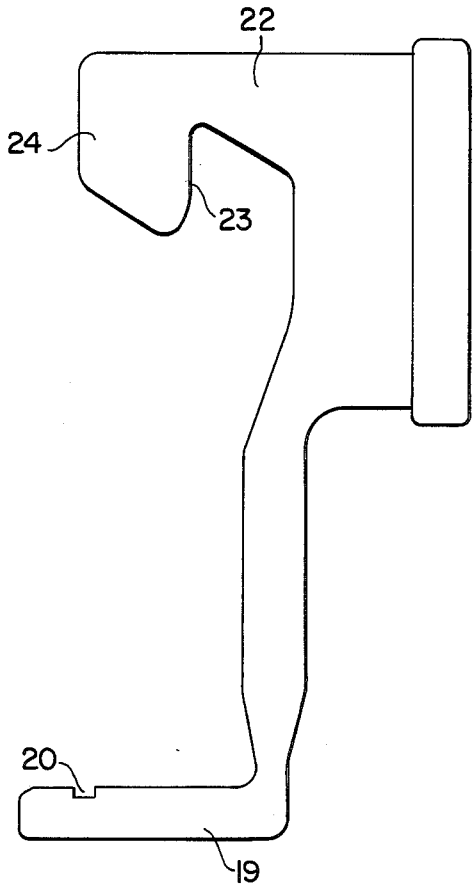
FIG. 5 is a view of the clapper, normal to the plane of the sash.

FIG. 5 shows the shape of the clapper 7 in more detail. The foot 19 of the clapper has a notch 20 which engages the clip 8 of the carrier for permanent attachment of the two parts. The dimensions of the clapper foot are such that it fits tightly in an aperture 21 in the carrier (shown in FIG. 4), restraining the clapper from moving vertically relative to the carrier and locating it centrally between the vertical members of the carrier. FIG. 5 also shows the thin section 13 of the clapper, which acts as a flexure or hinge. At the upper end of the clapper is a hook 22 whose inner vertical surface 23 engages the end of the spring 2 when the clapper is assembled with the carrier. The clapper upper end is formed into a tab 24 which is used for initial installation of the invention into the slotted channel of a jamb liner.

Figure 6:
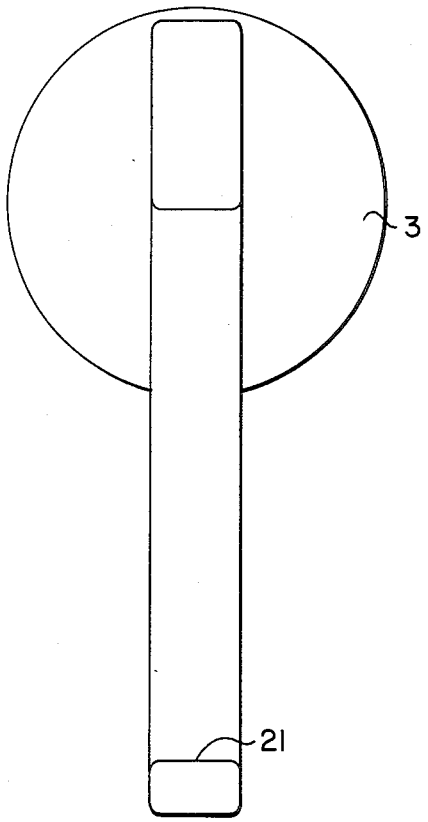
FIG. 6 is a view of the clapper showing the side which faces the sash.

FIG. 6 shows the circular profile of the clapper braking element 3. The center of this circle is approximately at the height where the end of the spring engages the clapper vertical surface 23 (FIG. 5). In FIG. 4 the two semi-circular braking elements 4 and 14 of the carrier are shown. The common center of these braking elements is aligned with the center of the clapper braking element 3.

Referring first to FIG. 1, operation of the Spring Force Compensator will be described in detail. The braking force of the invention is developed by action of the end of the spring 2 on the vertical surface 23 of the clapper hook and the inclined surface 25 of the carrier. The upward force of the spring supports the carrier, but the inclination of surface 25 urges the end of the spring towards the vertical surface 23 of the clapper hook. With the end of the spring in the position shown, it applies forces on both carrier and clapper, in directions which pull the respective braking elements together and cause them to frictionally engage the surfaces of the slotted channel. No vertical force is transmitted to the clapper by the spring, thus the entire support of the sash is through the carrier. The braking force is proportional to the spring force, because the frictional coefficient of braking elements 3, 4 and 14 on the slotted channel 5 is constant and because the angle of the inclined surface 25 is constant. Little actual sideways motion of the spring end is required for braking force to be developed, once the spring has seated itself. Wear on the parts is minimal because of the small relative motion which occurs between them.

The compensating frictional force of the invention is developed in two components. The force developed by carrier braking elements 4 and 14 is applied directly to the carrier. The force of clapper braking element 3, however, is transmitted to the carrier through the vertical length of the clapper, through the thin section 13, and is coupled to the carrier by the clapper foot 19, which is tightly held in the carrier aperture 21. Essentially none of this force is applied to the clip 8, which only serves to maintian the clapper foot 19 tightly engaged with the carrier aperture 21. The shape of the clapper is such that the force couple produced on the clapper flexure by vertical frictional force is minimal, so the flexure may be thin in section. Because actual motion of the upper end of the clapper parallel to the plane of the sash during sash movement is very small, deflections of the clapper flexure are extremely small, and the material will not tend to fatigue with time.

The invention develops its force for control of sash motion by squeezing the two surfaces of the slotted channel between opposed braking elements. There is no force on the slotted channel which would tend to expand it or separate it from the supporting structure of the jamb liner.

FIG. 1 shows that the center of the platform 9 supporting the sash is directly under the spring attachment point. This minimizes any tendency of the invention to develop a force couple on the braking elements. Also, the spring is centrally located in the sash plow region, which reduces the possibility of contact between the spring and the spring cover during motion of the sash, and the noise which would be produced thereby.

The circular profile of braking elements 3, 4 and 14, combined with the location of the spring attachment point near their centers, allows the Spring Force Compensator to rotate about the spring attachment point with essentially no change in the mechanical advantage of the inclined surface 25 or the area of frictional engagement between the braking elements and the slotted channel. Thus the invention may be used equally well on a top or bottom sash, which have different slopes relative to a normal to the plane of the sash.

The frictional force developed by the Spring Force Compensator may be established by choice of the angle of the inclined surface 25. A nearly horizontal surface would produce little or no frictional force on the slotted channel in response to the upward supporting force of the spring. An angle of 45 degrees from the vertical will make the compressive force on the braking elements approximately equal to the force of the spring, and an angle closer to the vertical will increase the force on the braking elements even more. The actual angle for a given design will depend on the frictional coefficient of the materials used for the jamb liner and the braking elements, and also on how much force is needed to supplement the friction provided by the jamb liner itself.

Figure 7:
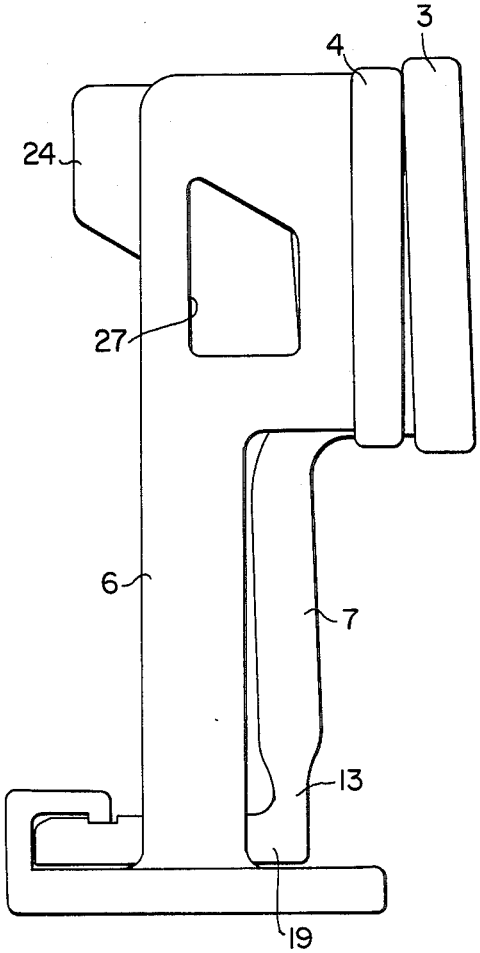
FIG. 7 shows the assembled carrier and clapper before they are attached to the balance spring or frictional engaged with the slotted channel of the jamb liner.

FIG. 7 shows an assembly of the carrier and clapper of the invention before attachment to a spring and before engagement of the braking elements with a slotted channel of a jamb liner. The free shape of the clapper 7 is such that when the clapper foot 19 is inserted into the carrier aperture 21 and engaged with the clip 8, the braking surfaces 3, 4 and 14 are held together as shown. In order to initially apply the Spring Force Compensator to a jamb liner slotted channel, some means of temporarily opening up the space between the braking elements is required. This is provided by a tab 24 of the clapper. When this tab is pressed, the clapper flexure 13 will be bent, opening up the gap between the braking elements, and the device can be slid onto the channel. When pressure on the tab 24 is released, the unit will stay in position on the channel, held by the frictional force of the braking elements, which are urged together by the flexure. The slight biasing pressure on braking elements 3, 4 and 14, provided by the flexure, insures that the Spring Force Compensator will never be entirely free from frictional engagement with the channel.

A typical material used for the manufacture of the Spring Force Compensator is glass-filled nylon, although many other materials could be used. The critical properties of the material are its lubricity, mechanical strength, and freedom from distortion and creep under continuous load.

VARIATIONS WITHIN THE SCOPE OF THE INVENTION

While the end of the balance spring attached to the Spring Force Compensator is shown ideally to be horizontal and straight, actual spring ends are likely to be curved. If this is the case, the shape of the aperture 26 in the carrier may be modified to increase the bearing area of the spring. The spring end may also be lubricated or its surface treated to minimize wear on it and the Spring Force Compensator.

The point of attachment of the spring is close to the centerline of the circular braking element attached to the clapper. This allows the entire device to rotate about the center of the braking elements when it is applied to a lower sash having a bottom surface at an angle to the horizontal. This rotation will not change the area of braking elements contacting the jamb liner slotted channel because the braking elements are circular in profile. Thus the mechanical force produced by the invention will be highly independent of the sash platform angle. The point of attachment may be adjusted higher, lower, and closer to or further from the surface of the slotted channel, in order to provide a desirable force couple. This may be done, for example, to minimize stick-slip or reduce chatter during rapid motion of the device.

If it is desired to limit the frictional force produced by the invention, the distance separating the vertical surface 23 of the clapper 7 and the vertical surface 27 (FIG. 7) of the carrier 6 may be reduced. When the spring end contacts the vertical surface 27 of the carrier, no further increase in force output occurs. Stability of this adjustment depends on control of the jamb liner channel thickness.

Many of the dimensions of the Spring Force Compensator may be changed to suit a specific application. Many different means of attachment of the two parts are possible, besides that shown in the drawings. For example, conventional fasteners may be substituted for the clip of the preferred embodiment, or the two parts may be hinged with a conventional hinge and fasteners. With a highly sophisticated molding machine and mold the two parts of the invention may be combined into a single molded part, eliminating fasteners altogether.

The preferred embodiment of the invention shown in the drawings minimizes the vertical force on the clapper. However, the vertical surface 23 of the clapper can be inclined to allow the clapper to support some of the weight of the sash. If this is done, there may have to be some modification of the clapper cross-section 13, and possibly the means of attachment of the two parts will have to be changed.

It will be appreciated by those skilled in the art that many further variations are possible without departure from the spirit and scope of the invention.

I claim:

1. A device for spring force compensation in a sash holder having a support spring, for use in a jamb liner having a vertical slotted channel comprising:

(a) a carrier having an inclined surface at its upper end for engagement of the end of said spring, a support for said sash at its lower end, and a braking surface frictionally engaging a first surface of a portion of said slotted channel;

(b) a clapper having a foot at its lower end for attachment to said carrier, a vertical surface at its upper end, a thin flexible section between said upper and said lower ends and a braking surface frictionally engaging a second surface of said portion of said slotted channel opposed to said first surface;

(c) wherein said inclined surface of said carrier urges said end of said spring against said vertical surface of said clapper, causing said braking surface of said clapper to press against said first surface of said portion of said slotted channel and said braking surface of said carrier to press against said second surface of said portion of said slotted channel thus said device squeezes said portion of said slotted channel between said respective braking surfaces to create a braking force.

2. The device of claim 1 in which said braking surfaces of said carrier and said clapper are circular in profile.

3. The device of claim 2 in which said inclined surface is located near the center of the circular profiles of said braking surfaces.

4. The device of claim 1 in which said carrier lower end includes means for attachment of said clapper.

5. The device of claim 1 in which said inclined surface is the upper surface of an aperture in said carrier.

6. The device of claim 5 in which said clapper is in the form of a hook, and said vertical surface is an inner surface of said hook.

7. The device of claim 1 in which the free shape of said carrier and said clapper when assembled close the space between said braking surfaces.

8. The device of claim 7 in which said clapper further comprises a tab at the upper end for opening said space between said braking surfaces.

9. A device for spring force compensation in a sash holder having a support spring, for use in a jamb liner having a vertical slotted channel comprising:

(a) an integrally molded carrier having a fixed part and a movable part;

(b) wherein said movable part is attached at its lower end to the lower end of said fixed part by a thin flexible section;

(c) wherein said fixed part has an inclined surface at its upper end for engagement of the end of said spring, a support for said sash at its lower end, and a braking surface frictionally engaging a first surface of a portion of said slotted channel;

(d) wherein said movable part has a vertical surface at its upper end and a braking surface frictionally engaging a second surface of said portion of said slotted channel opposed to said first surface; and (e) wherein said inclined surface of said fixed part urges said end of said spring against said vertical surface of said movable part, causing said braking surface of said movable part to press against said first surface of said portion of said slotted channel and said braking surface of said fixed part to press against said second surface of said portion of said slotted channel, thus said device squeezes said portion of said slotted channel between said respective braking surfaces to create a braking force.

10. The device of claim 9 in which said braking surfaces of said fixed and said movable part are circular in profile.

11. The device of claim 10 in which said inclined surface is located at the center of the circular profiles of said braking surfaces.

12. The device of claim 9 in which said inclined surface is the upper surface of an aperture in said fixed part.

13. The device of claim 12 in which said movable part is in the form of a hook, and said vertical surface is an inner surface of said hook.

* * * * *